US008079117B2

(12) United States Patent
Pontaoe

(10) Patent No.: US 8,079,117 B2
(45) Date of Patent: Dec. 20, 2011

(54) BUCKLE ASSEMBLY

(75) Inventor: John S. Pontaoe, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 386 days.

(21) Appl. No.: 12/388,719

(22) Filed: Feb. 19, 2009

(65) Prior Publication Data

US 2009/0241306 A1 Oct. 1, 2009

Related U.S. Application Data

(60) Provisional application No. 61/040,791, filed on Mar. 31, 2008.

(51) Int. Cl.
*A44B 11/25* (2006.01)

(52) U.S. Cl. ..... 24/616; 24/614; 24/615; 24/635; 24/651; 24/645

(58) Field of Classification Search ..... 24/614, 24/615, 629, 633, DIG. 51, 635, 645, 634, 24/642, 651, 616
See application file for complete search history.

(56) References Cited

U.S. PATENT DOCUMENTS 3,171,183 A * 3/1965 Johnston ..... 24/635
3,345,070 A * 10/1967 Porter et al. ..... 473/502
3,585,692 A * 6/1971 Le Mire ..... 24/635
4,709,949 A * 12/1987 Umezawa et al. ..... 292/6
5,465,472 A * 11/1995 Matoba ..... 24/625
5,791,026 A * 8/1998 Anscher ..... 24/615
6,003,213 A 12/1999 Keller et al. ..... 24/635
6,427,292 B1 * 8/2002 Seifert ..... 24/265 EC
6,460,232 B2 * 10/2002 Maruoka ..... 24/615
2003/0182777 A1 * 10/2003 Kim ..... 24/615

OTHER PUBLICATIONS

International Search Report and Written Opinion for PCT/US2009/034830.

* cited by examiner

*Primary Examiner* — Robert Sandy
*Assistant Examiner* — Rowland D Do
(74) *Attorney, Agent, or Firm* — Mark W. Croll; Paul F. Donovan

(57) ABSTRACT

A buckle assembly including a first buckle portion having an outwardly projecting engagement member. The assembly further includes a second buckle portion including an extended socket structure with one or more resilient biasing arms disposed radially outboard of the extended socket structure. A sleeve member is disposed in reciprocating relation to the second buckle portion at least partially about the extended socket structure. A camming surface is disposed in substantially fixed relation to the sleeve member radially outboard from the resilient biasing arms. The camming surface includes at least one concavity engaging one or more of the resilient biasing arms.

20 Claims, 5 Drawing Sheets

FIG. —1—

BUCKLE ASSEMBLY

CROSS-REFERENCE TO RELATED APPLICATION

This Application claims the benefit of U.S. Provisional Application Ser. No. 61/040,791 filed Mar. 31, 2008, the contents of which are hereby incorporated by reference as if fully set forth herein.

FIELD OF THE INVENTION

The present invention relates generally to a buckle, and more particularly, to a mating buckle assembly adapted for attaching end portions of web-like materials in a secure manner.

BACKGROUND OF THE INVENTION

Mating buckle assemblies utilizing ball and socket connections are generally known. By way of example only, such mating buckle assemblies may be used to secure extremities or end portions of web-like materials including straps used on child restraints, personal flotation devices, waist and backpack belts, head protection gear, luggage and handbags, as well as numerous other applications. Various exemplary known structures for mating buckle assemblies are set forth in U.S. Pat. No. 6,003,213 to Keller et al. the contents of which are hereby incorporated by reference in their entirety as if fully set forth herein. While such known structures are believed to be highly effective in many environments of use, the general design is somewhat complex. Accordingly, constructions providing the benefits of such prior devices while enhancing ease of construction and/or operational performance would be desirable.

SUMMARY OF THE INVENTION

According to one aspect, the present invention provides advantages and alternatives over the prior art by providing a buckle assembly including a first buckle portion having an outwardly projecting engagement member. The assembly further includes a second buckle portion including an extended socket structure. The extended socket structure includes resilient socket arms cooperatively defining a socket head including an outwardly expandable socket opening adapted to receive the engagement member. At least one detent member projects away from a surface of the extended socket structure at a position rearward of the socket head. The second buckle portion further includes resilient biasing arms disposed radially outboard of the extended socket structure. A sleeve member is disposed in reciprocating relation at least partially about the extended socket structure and the biasing arms. A camming surface is disposed radially outboard from the resilient biasing arms. The camming surface includes at least one concave zone operatively engaging at least one biasing surface of one or more of the resilient biasing arms.

According to another aspect, the present invention provides a buckle assembly including a first buckle portion having a face including a raised platform surface and a bulbous engagement member projecting outwardly away from the raised platform surface. The assembly further includes a second buckle portion including an extended socket structure. The extended socket structure includes an expansible socket head adapted to receive the bulbous engagement member. Detent members project away from a surface of the extended socket structure at positions rearward from the socket head. A plurality of resilient biasing arms is disposed radially outboard of the extended socket structure. A sleeve member is disposed in reciprocating relation at least partially about the extended socket structure and the biasing arms. The sleeve member defines a pass-through opening sized to receive the bulbous engagement member and the raised platform surface. Camming surfaces are positioned radially outboard from the resilient biasing arms. The camming surfaces include concave zones engaging the resilient biasing arms.

According to yet another aspect, the present invention provides a buckle assembly including a first buckle portion having a face including a raised platform surface and a bulbous engagement member projecting outwardly away from the raised platform surface. The assembly further includes a second buckle portion including an extended socket structure extending away from a cross member. The extended socket structure includes a plurality of resilient socket arms cooperatively defining an expansible socket head adapted to receive the bulbous engagement member. At least one detent member projects away from a surface of the extended socket structure at a position between the cross member and the socket head. A plurality of resilient biasing arms is disposed radially outboard of the extended socket structure. A sleeve member is disposed in reciprocating relation at least partially about the extended socket structure and the biasing arms. The sleeve member defines a pass-through opening sized to receive the bulbous engagement member and the raised platform surface. A brace member is disposed between the second buckle portion and an interior surface of the sleeve member. The brace member includes a collar segment disposed about the resilient biasing arms at a position between the cross member and the detent member. The brace member further includes a plurality of camming arms extending away from the collar segment adjacent interior surfaces of the sleeve member. The camming arms define camming surfaces including concave zones engaging biasing surfaces of one or more of the resilient biasing arms. The collar segment defines a blocking surface disposed rearward of the detent member. The blocking surface is adapted to engage the detent member upon attempted withdrawal of the second buckle portion from the sleeve.

While the invention has been illustrated and will hereinafter be described in connection with certain exemplary embodiments and practices, it is to be understood that in no event is the invention to be limited to such illustrated and described embodiments and practices. On the contrary, it is intended that the present invention shall extend to all alternatives and modifications as may embrace the general principles of this invention within the full and true spirit and scope thereof.

DETAILED DESCRIPTION OF PREFERRED EMBODIMENTS

Figure 1:
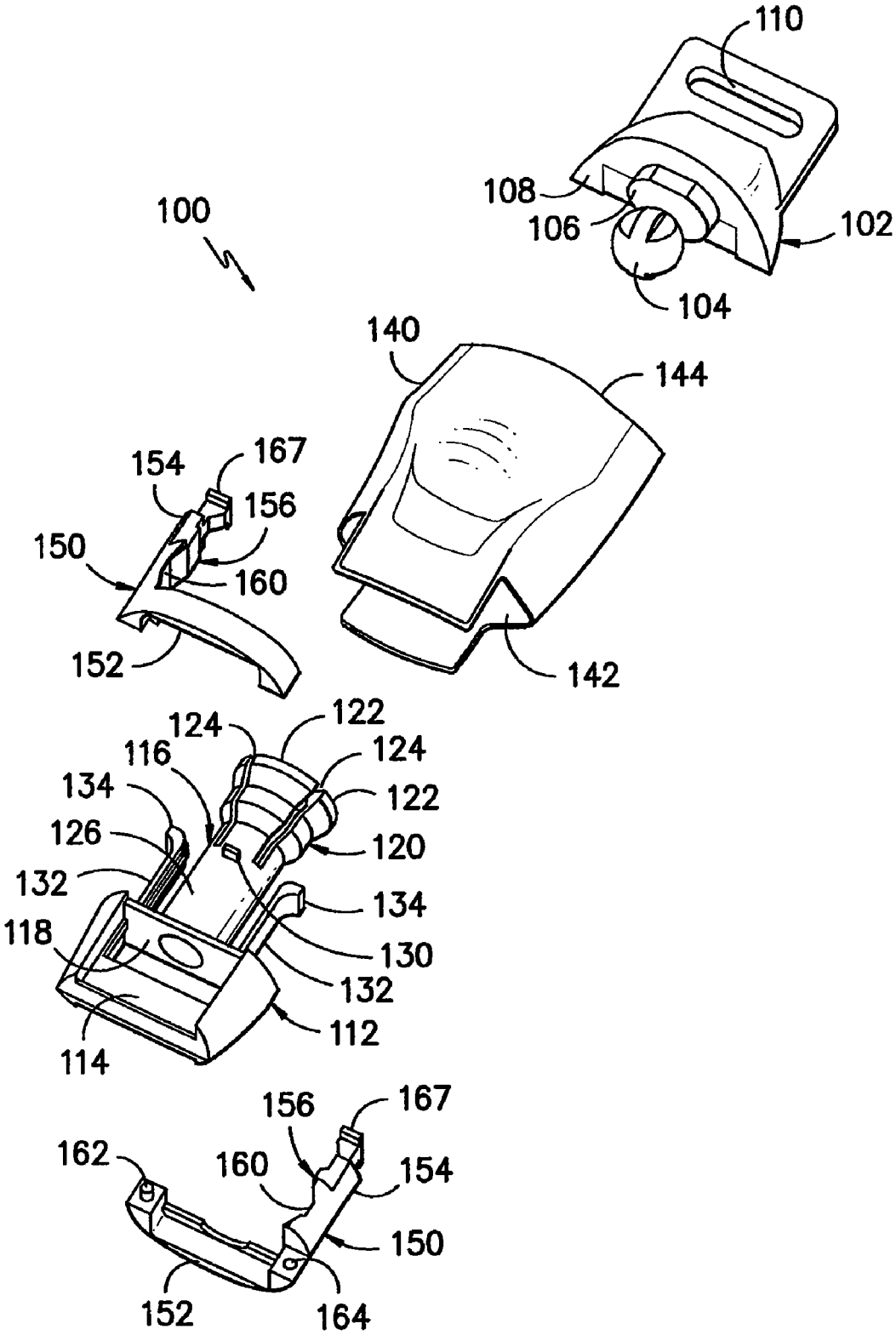
FIG. 1 is an exploded perspective view of an exemplary ball and socket buckle assembly adapted for adjoining elongate web members.

Reference will now be made to the drawings, wherein to the extent possible, like elements are designated by like reference numerals throughout the various views. FIG. 1 illustrates an exemplary buckle 100 usable for coupling or fastening extremities of web-like materials. The buckle 100 includes generally, a first buckle portion 102 having an outwardly projecting male engagement member 104. As illustrated, the male engagement member 104 is of a generally bulbous ball-like construction. In the illustrated configuration, the male engagement member 104 projects outwardly from a raised platform surface 106 disposed across a face 108 of the first buckle portion 102. In the illustrated construction, the first buckle portion 102 further includes a first eyelet 110 for engagement and retention of an elongate strap or other web-like material (not shown).

The buckle 100 further includes a second buckle portion 112. The second buckle portion 112 includes a second eyelet 114 adapted to receive a strap or other web-like element (not shown). In the illustrated and exemplary construction, the second buckle portion 112 includes an extended socket structure 116 projecting outwardly away from a crossing member 118. In the illustrated construction, the extended socket structure 116 includes an expandable socket head 120 formed by two or more flared resilient socket arms 122. As shown, the socket arms 122 are separated by expansion slots 124 arranged in spaced relation circumferentially about the socket head 120. The exemplary socket structure 116 also includes a stem member 126 extending between the crossing member 118 and the socket head 120. In the illustrated construction, one or more detents 130 project outwardly away from the stem member 126 at positions between the crossing member 118 and the socket head 120.

In the illustrated arrangement, the second buckle portion 112 further includes a pair of resilient biasing arms 132 extending away from the crossing member 118. The resilient biasing arms 132 are disposed adjacent opposing lateral sides of the stem member 126. In the illustrated construction, the biasing arms 132 are of a generally "J" shape profile including distal segments 134 projecting outwardly away from the stem member 126. As will be described further hereinafter, the distal segments 134 act against cooperating camming surfaces to continuously urge the second buckle portion to a defined, neutral axial position within the buckle 100.

The exemplary buckle 100 further includes a sleeve member 140. The sleeve member 140 includes a proximal opening 142 adapted to receive and retain the second buckle portion 112. The sleeve member 140 also includes a distal opening 144 projecting generally towards the first buckle portion 102. Thus, the sleeve member 140 is adapted to surround the second buckle portion 112.

In the illustrated exemplary construction, a brace structure 150 is disposed about the second buckle portion 112. As shown, the exemplary brace structure 150 is a two-piece construction. However, it is likewise contemplated that a construction using a single piece or more than two pieces may be used if desired. The illustrated exemplary brace structure 150 includes a collar portion 152 adapted to be positioned in forward, adjacent relation to the crossing member 118 in the final assembled condition such that the collar portion 152 is between the crossing member 118 and the detent 130. The brace structure 150 further includes a pair of opposing camming arms 154. As best illustrated through joint reference to FIGS. 2, 4, 6 and 8, the camming arms 154 extend inwardly adjacent lateral interior walls of the sleeve member 140 generally in the same direction as the stem member 126. Thus, the camming arms are in outboard relation to the biasing arms 132. In this arrangement, the camming arms 154 present inwardly facing opposing camming surfaces 156. The camming surfaces 156 are adapted to engage the outwardly projecting distal ends 134 of the biasing arms 132. In particular, the camming surfaces 156 include opposing concave zones 160. Interaction between the concave zones 160 and the distal ends 134 of the biasing arms 132 continuously urges the distal ends 134 towards the base of the concave zones. In the illustrated exemplary construction, the brace structure 150 is formed from two cooperating pieces that are fit together using cooperating pins 162 (only one shown) and acceptance holes 164 (only one shown) disposed at opposing segments of the collar portion 152. Of course, other attachment arrangements may be used. A single piece structure or a structure with more than two pieces may likewise be utilized, if desired. Likewise, while the camming surfaces 156 in the illustrated embodiment are independent from the sleeve member 140, it is likewise contemplated that the camming surfaces 156 may be integral with the sleeve member formed by molding, machining or the like if desired.

Figure 2:
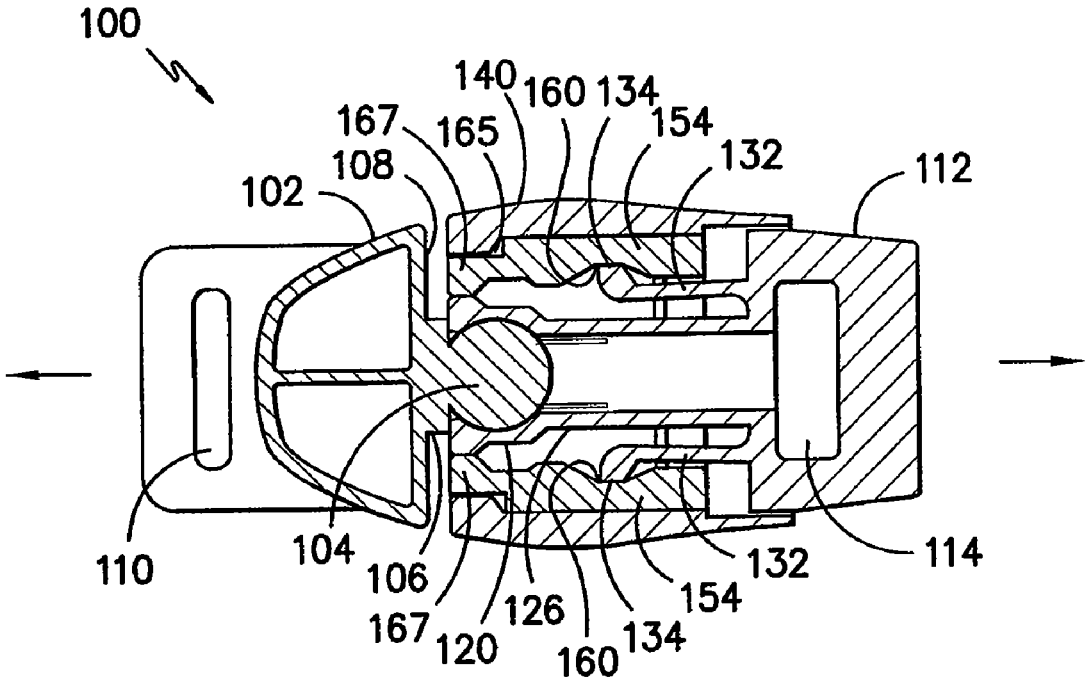
FIG. 2 is a cut-away top view of the ball and socket buckle assembly of FIG. 1 in assembled condition with the ball and socket in a locked orientation.

In assembly of the buckle 100, the second buckle portion 112 with the surrounding brace structure 150 is inserted into the proximal opening 142 of the sleeve member 140. During this insertion, the camming arms 154 are caused to flex inwardly as they ride along sloped interior surfaces 165 of the sleeve member 140 (FIG. 2). As best illustrated through joint reference to FIGS. 1 and 8, in the illustrated construction the camming arms 154 include flared terminal ends 167 of enhanced height dimension. Upon full insertion of the brace structure 150, the flared terminal ends 167 of the camming arms 154 snap outwardly after passing the sloped interior surfaces 165 and are captured within lateral pockets 169 at the distal opening 144. This snap-in relation thereafter prevents the brace structure 150 from being withdrawn back through the proximal opening 142. Moreover, there is substantially no relative axial movement between the brace structure 150 and the sleeve member 140.

Figure 6:
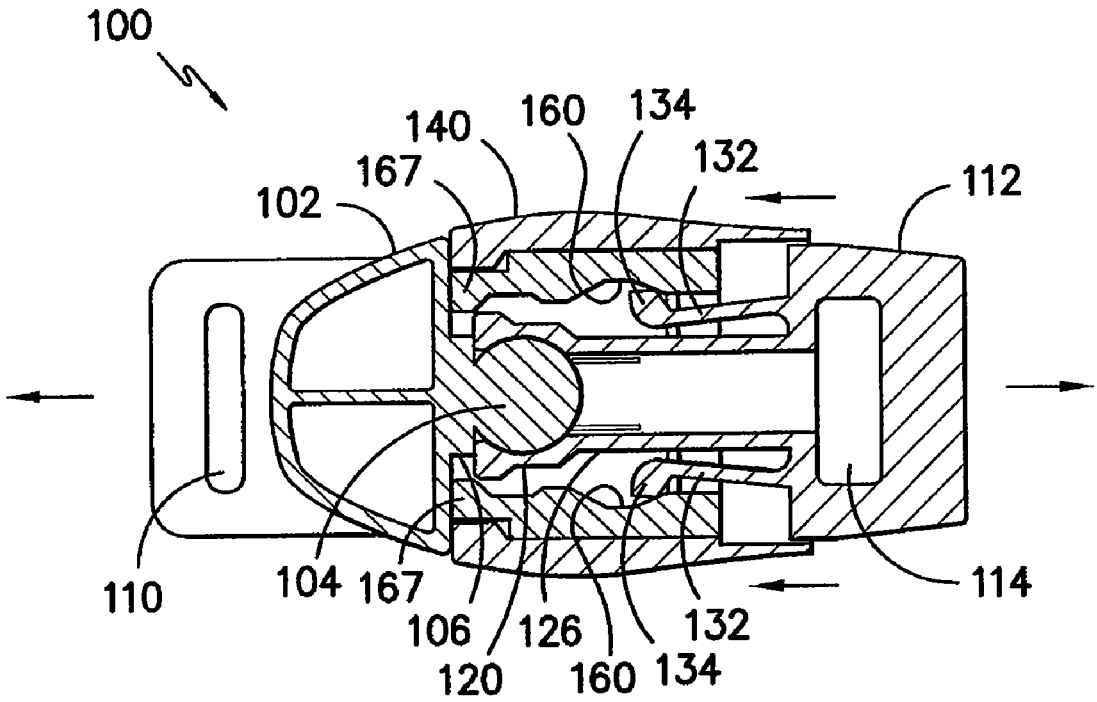
FIG. 6 is a cut-away top view similar to FIG. 2 illustrating the ball and socket buckle assembly of FIG. 1 in assembled condition with the ball and socket in a retracted orientation.
Figure 7:
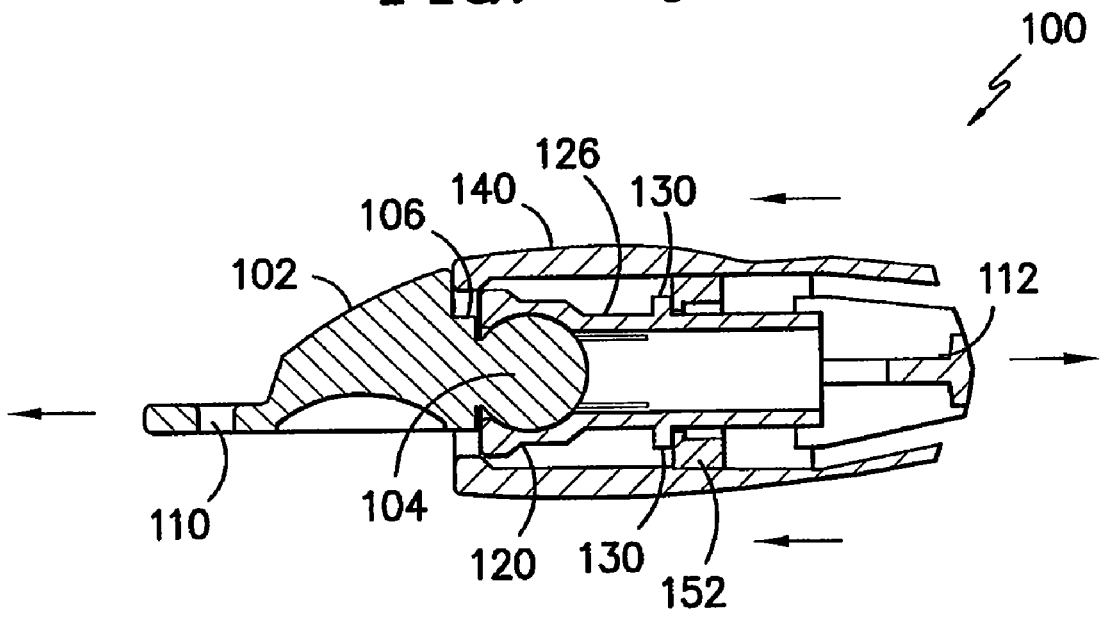
FIG. 7 is a cut-away side view similar to FIG. 3 illustrating the ball and socket buckle assembly of FIG. 1 in assembled condition with the ball and socket in a retracted orientation.
Figure 8:
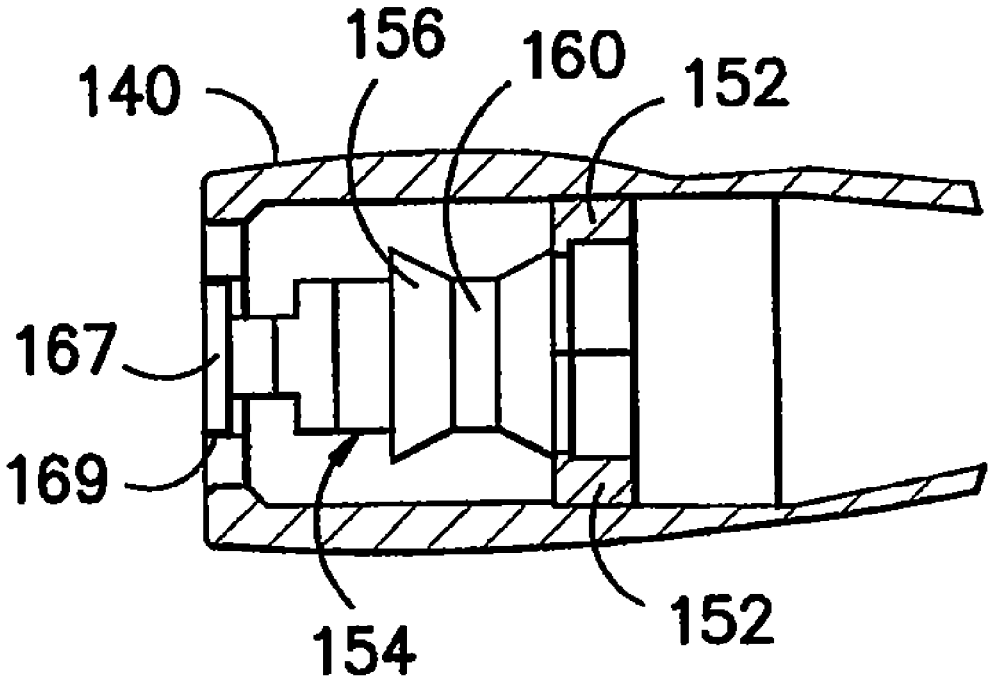
FIG. 8 is a cut-away side view similar to FIG. 3 but with the ball and socket removed to illustrate a locking relation of an internal bracing structure.

In the assembled condition, the brace structure 150 is held in a substantially stable and fixed relation across the interior surface of the sleeve member 140. However, the second buckle portion 112 is able to slide relative to the brace structure 150 and surrounding sleeve member 140. Specifically, the second buckle portion 112 may be moved inwardly relative to the proximal opening 142 until encountering obstruction between the crossing member 118 and the collar portion 152 of the bracket structure as shown schematically in FIGS. 4 and 5. Likewise, the second buckle portion 112 may be moved outwardly away from the proximal opening 142 until obstruction is encountered between the detents 130 and the collar portion 152 of the brace structure 150 such that the collar portion 152 acts as a blocking surface as illustrated in FIGS. 6 and 7.

Figure 3:
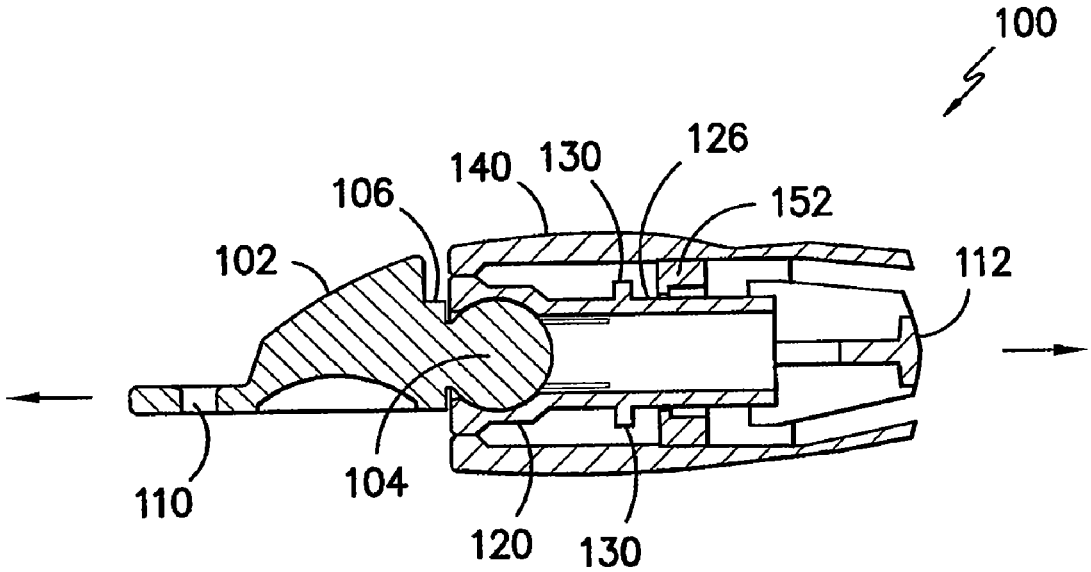
FIG. 3 is a cut-away side view of the ball and socket buckle assembly of FIG. 1 in assembled condition with the ball and socket in the locked orientation of FIG. 2.

In operation, the first buckle portion 102 supporting a first web-like material (not shown) may be pressed into the socket head 120 which is supported at the interior of the sleeve member 140. In this relationship, the socket arms 122 expand and clamp about the male engagement member 104. This clamping engagement is illustrated in FIGS. 2 and 3 wherein the buckle 100 is in a generally unstressed neutral condition. In this neutral condition, the distal ends 134 of the biasing arms 132 reside generally at the base of the depressions formed by the opposing concave zones 160 across the camming surfaces 156 of the camming arms 154. As will be appreciated, absent any applied pulling or pushing stresses, the distal ends 134 of the biasing arms 132 are urged continuously to the base of the concavity where the slope is substantially zero. Thus, by orienting the position of the concave zones 160, a neutral axial position for the second buckle portion 112 along the length of the sleeve member is established.

As will be appreciated, while the illustrated exemplary construction utilizes a pair of camming arms 154 engaging a pair of opposing concave zones at camming surfaces 156, it is likewise contemplated that a greater or lesser number of camming arms 154 and/or camming surfaces 156 may be used if desired. By way of example only, and not limitation, a single camming arm may be used in conjunction with a single camming surface. Likewise, three or more camming arms and camming surfaces may be used if desired.

As best illustrated in FIGS. 2 and 3, according to the illustrated and potentially preferred practice, in the neutral position, a substantially flush surface is formed by the ends of the socket head 120 in conjunction with the sleeve member 140 and the terminal ends 167 of the camming arms 154. This flush arrangement aids in the ability of the raised platform surface 106 to seat against the terminal ends of the socket head 120 in a relatively tight relation thereby aiding in the prevention of dirt or other contamination entering into the interior of the buckle during normal operation.

Figure 4:
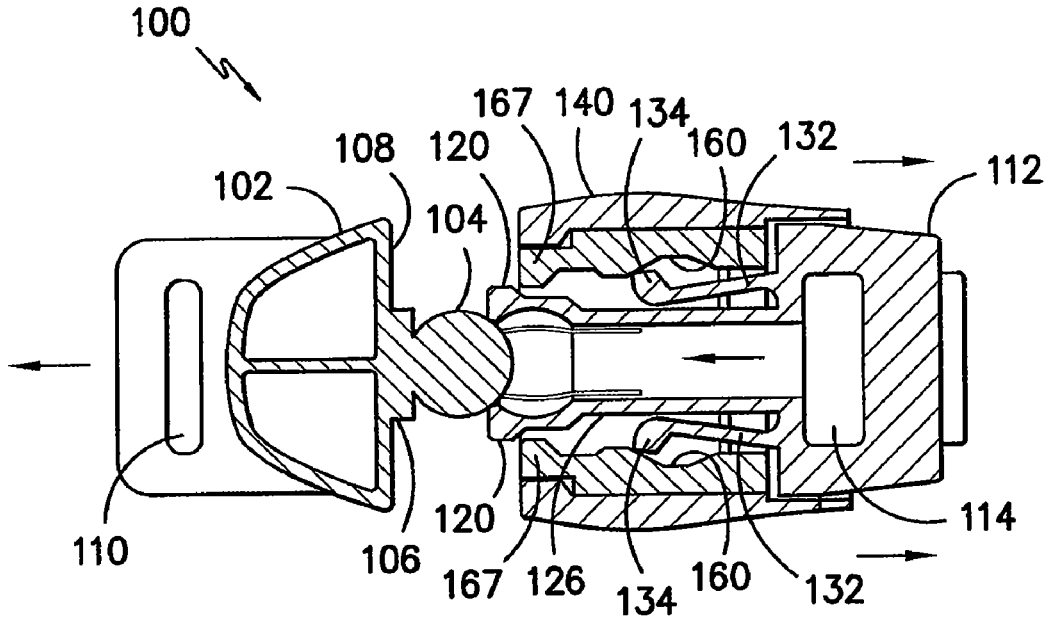
FIG. 4 is a cut-away top view similar to FIG. 2 illustrating the ball and socket buckle assembly of FIG. 1 in assembled condition with the ball and socket in a release orientation.
Figure 5:
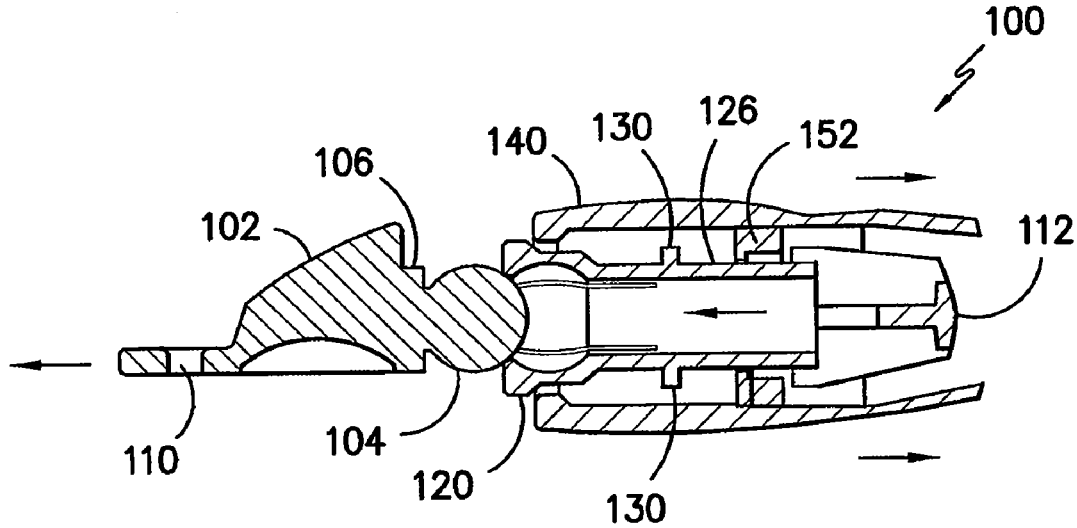
FIG. 5 is a cut-away side view similar to FIG. 3 illustrating the ball and socket buckle assembly of FIG. 1 in assembled condition with the ball and socket in a release orientation.

As illustrated through joint reference to FIGS. 4 and 5, upon the application of a separating force as indicated by the directional arrows, the male engagement member 104 may be pulled away from the socket head 120 thereby causing the engagement between the first buckle portion 102 and the second buckle portion 112 to be released. As shown, during the disengagement, the second buckle portion 112 is moved forward within the sleeve member 140 until further movement is blocked. In this forward extended position, the distal ends 134 of the biasing arms 132 have been moved along the sloped surfaces of the concave zones 160. Once the separation between the first buckle portion 102 and the second buckle portion 112 is complete, the biasing force of the distal ends 134 against the sloped surface of the concave zones 160 causes a relative movement between the second buckle portion 112 and the sleeve member 140 as the distal ends 134 retreat back to the base of the concavities to resume the position illustrated in FIG. 2. As will be appreciated, in this orientation the socket head 120 resumes the substantially flush relation relative to the ends of the sleeve member 140 and brace structure 150. Maintaining this flush relation aids in avoiding introduction of outside contaminants.

As illustrated in FIGS. 6 and 7, in the event that a lifting force or the like is applied to the second buckle portion 112 as shown by the directional arrows, the second buckle portion 112 moves relative to the sleeve member 140 and carries the male engagement member 104 further into the interior of the sleeve member 140. However, as best shown in FIG. 7, the degree of relative movement between the sleeve member 140 and the second buckle portion 112 is limited by the engagement between the detents 130 and the collar portion 152 of the brace structure 150. Thus, there is no disengagement between the first buckle portion 102 and the second buckle portion 112. Accordingly, the buckle 100 may be used as a lifting device if desired.

As noted previously, in the illustrated exemplary construction, the male engagement member 104 projects away from a raised platform surface 106. In the illustrated and potentially preferred practice, the distal openings within the sleeve member 140 are sized to permit passage of the raised platform surface while blocking insertion of the surrounding face 108 of the first buckle portion 102. In such an arrangement, the raised platform surface 106 establishes and maintains contact with the terminal ends of the socket arms 122. Moreover, this arrangement aids in avoiding unintentional disengagement due to application of torsion forces.

Of course, it is to be understood that Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A buckle assembly comprising:

a first buckle portion including an outwardly projecting engagement member;

a second buckle portion including an extended socket structure, the extended socket structure including a plurality of resilient socket arms cooperatively defining an expansible socket head adapted to receive the engagement member, at least one detent member projecting away from a surface of the extended socket structure, the second buckle portion further including at least one resilient biasing arm disposed radially outboard of the extended socket structure;

a sleeve member disposed in reciprocating relation to the second buckle portion at least partially about the extended socket structure and said at least one resilient biasing arm;

at least one camming surface disposed radially outboard from said at least one resilient biasing arm in substantially fixed axial relation to the sleeve member, said at least one camming surface including at least one concave zone operatively engaging said at least one resilient biasing arm.

2. The buckle assembly as recited in claim 1, further including a blocking surface disposed rearward of the detent member, the blocking surface being adapted to engage the detent member upon attempted withdrawal of the second buckle portion from the sleeve.

3. The buckle assembly as recited in claim 2, wherein the extended socket structure includes an elongate stem member extending axially away from a crossing member to the socket head.

4. The buckle assembly as recited in claim 3, wherein the blocking surface is disposed in overlying relation to the elongate stem member at a position between the crossing member and the at least one detent member.

5. The buckle assembly as recited in claim 2, wherein the outwardly projecting engagement member is characterized by a substantially bulbous construction.

6. The buckle assembly as recited in claim 5, wherein the outwardly projecting engagement member is a ball.

7. The buckle assembly as recited in claim 2, wherein said at least one resilient biasing arm has a substantially J-shaped profile including an end segment projecting radially away from the extended socket structure, the end segment defining a camming surface normally disposed at said at least one concave zone.

8. The buckle assembly as recited in claim 1 including a pair of resilient biasing arms disposed adjacent opposing sides of the extended socket structure and a pair of camming surfaces, each of said pair of camming surfaces being disposed in opposing, contacting relation to relation to one of said pair of resilient biasing arms.

9. The buckle assembly as recited in claim 8, wherein each of said pair of resilient biasing arm has a substantially J-shaped profile including an end segment projecting radially away from the extended socket structure, the end segment defining a camming surface normally disposed at a concave zone disposed at one of said pair of camming surfaces.

10. A buckle assembly comprising:

a first buckle portion, the first buckle portion having a face including a raised platform surface and a bulbous engagement member projecting outwardly away from the raised platform surface;

a second buckle portion including an extended socket structure, the extended socket structure including an expansible socket head adapted to receive the bulbous engagement member, a plurality of detent members projecting away from a surface of the extended socket structure at positions rearward from the socket head, the second buckle portion further including a plurality of resilient biasing arms disposed radially outboard of the extended socket structure;

a sleeve member disposed in reciprocating relation to the second buckle portion at least partially about the extended socket structure and the biasing arms, the sleeve member defining at least a pass-through opening sized to receive the bulbous engagement member and the raised platform surface;

a plurality of camming surfaces disposed radially outboard from the resilient biasing arms in substantially fixed axial relation to the sleeve member, the camming surfaces each including at least one concave zone engaging at least one of the resilient biasing arms.

11. The buckle assembly as recited in claim 10, further including a blocking surface disposed rearward of the detent member, the blocking surface being adapted to engage the detent member upon attempted withdrawal of the second buckle portion from the sleeve.

12. The buckle assembly as recited in claim 11, wherein the extended socket structure includes an elongate stem member extending axially away from a crossing member to the socket head.

13. The buckle assembly as recited in claim 12, wherein the blocking surface is disposed in overlying relation to the elongate stem member at a position between the crossing member and said plurality of detent members.

14. The buckle assembly as recited in claim 13, wherein at least a portion of said plurality of resilient biasing arms has a substantially J-shaped profile including an end segment projecting radially away from the extended socket structure, the end segment defining a camming surface normally disposed at a concave zone disposed at one of said plurality of ramming surfaces.

15. A buckle assembly comprising:

a first buckle portion, the first buckle portion having a face including a raised platform surface and a bulbous engagement member projecting outwardly away from the raised platform surface;

a second buckle portion including an extended socket structure extending away from a cross member, the extended socket structure including a plurality of resilient socket arms cooperatively defining an expansible socket head adapted to receive the bulbous engagement member, at least one detent member projecting away from a surface of the socket arms at a position between the cross member and the socket head, the second buckle portion further including a plurality of resilient biasing arms disposed radially outboard of the extended socket structure;

a sleeve member having a proximal opening and a distal opening, the sleeve member disposed in reciprocating relation to the second buckle portion at least partially about the extended socket structure and the biasing arms, the distal opening being sized to receive the bulbous engagement member and the raised platform surface;

a brace member disposed between the second buckle portion and an interior surface of the sleeve member in substantially fixed axial relation to the sleeve member, the brace member including a collar segment disposed about the resilient biasing arms at a position between the cross member and the detent member, the brace member further including a plurality of camming arms extending away from the collar segment in adjacent relation to interior surfaces of the sleeve member, the camming arms defining camming surfaces including at least one concave zone engaging at least one biasing surface of at least one of the resilient biasing arms, the collar segment defining a blocking surface adapted to engage the detent member upon attempted withdrawal of the second buckle portion from the sleeve.

16. The buckle assembly as recited in claim 15, wherein the extended socket structure includes an elongate stem member extending axially away from the crossing member to the socket head.

17. The buckle assembly as recited in claim 15, wherein the brace member is a multi-piece construction.

18. The buckle assembly as recited in claim 17, wherein the brace member is a multi-two-piece construction adjoined by cooperating pins and pin openings at the collar segment.

19. The buckle assembly as recited in claim 15, wherein at least a portion of said plurality of resilient biasing arms has a substantially J-shaped profile including an end segment projecting radially away from the extended socket structure, the end segment defining a camming surface normally disposed at a concave zone disposed at one of said caroming surfaces.

20. The buckle assembly as recited in claim 15, wherein the sleeve member includes sloped interior surfaces adapted to urge the camming arms inwardly during insertion of the brace member, and wherein the brace member is held in snap-fit relation within the sleeve member following insertion.

* * * * *